US009024980B2

(12) United States Patent
Lin et al.

(10) Patent No.: US 9,024,980 B2
(45) Date of Patent: May 5, 2015

(54) METHOD AND APPARATUS FOR CONVERTING RGB DATA SIGNALS TO RGBW DATA SIGNALS IN AN OLED DISPLAY

(71) Applicant: AU Optronics Corporation, Hsinchu (TW)

(72) Inventors: Hui-Feng Lin, Hsinchu (TW); Sheng-Wen Cheng, Hsinchu (TW); Ming-Sheng Lai, Hsinchu (TW); Lu-Yao Wu, Hsinchu (TW)

(73) Assignee: AU Optronics Corporation, Hsinchu (TW)

( * ) Notice: Subject to any disclaimer, the term of this patent is extended or adjusted under 35 U.S.C. 154(b) by 21 days.

(21) Appl. No.: 13/803,530

(22) Filed: Mar. 14, 2013

(65) Prior Publication Data

US 2014/0267442 A1 Sep. 18, 2014

(51) Int. Cl.
*G09G 5/10* (2006.01)
*G09G 3/32* (2006.01)

(52) U.S. Cl.
CPC ..... *G09G 3/3208* (2013.01)

(58) Field of Classification Search
None
See application file for complete search history.

(56) References Cited

U.S. PATENT DOCUMENTS

| | | | | |
|---|---|---|---|---|
| 2004/0135899 | A1* | 7/2004 | Suemoto | 348/223.1 |
| 2007/0052735 | A1* | 3/2007 | Chou | 345/690 |
| 2007/0236517 | A1* | 10/2007 | Kimpe | 345/690 |
| 2011/0148910 | A1* | 6/2011 | Botzas et al. | 345/600 |

* cited by examiner

*Primary Examiner* — Muhammad N Edun

(57) ABSTRACT

A method for converting input RGB data signals to output RGBW data signals for use in an OLED display is disclosed. In the OLED display, each pixel has three color sub-pixels in RGB and one W sub-pixel. Input RGB data signals in signal space are normalized and converted into input data in luminance space. A baseline adjustment level is determined from the input data and is used to compute baseline adjusted data in luminance space. After being converted from luminance space into signal space, baseline adjusted data in RGBW are represented by N binary bits presented to the four sub-pixels. To suit the color characteristics of the display, color-temperature correction to the output signals is also carried out. In luminance space, the maximum color-temperature corrected output data fall within the range of 0.4/k and 0.5/k, with k being the ratio of W sub-pixel area to the color sub-pixel area.

20 Claims, 11 Drawing Sheets

METHOD AND APPARATUS FOR CONVERTING RGB DATA SIGNALS TO RGBW DATA SIGNALS IN AN OLED DISPLAY

FIELD OF THE INVENTION

The present invention relates generally to a color display and, in more specifically, to an OLED display having RGBW sub-pixels.

BACKGROUND OF THE INVENTION

Light-Emitting Diodes (LEDs) and Organic Light-Emitting Diodes (OLEDs) have been used in making color display panels. As with an LCD display, an OLED display produces color images based on three primary colors in R, G and B. A color pixel in an OLED display can be made of an R sub-pixel, a G sub-pixel and a B sub-pixel. In general, the response of the OLED material over current is approximately linear and, therefore, different colors and shades can be achieved by controlling the currents. The advantage of OLEDs over Liquid-Crystal Display (LCD) includes the fact that OLEDs are able to emit light whereas a pixel in an LCD acts as a light-valve mainly to transmit light provided by a backlight unit. Thus, an LED/OLED panel can, in general, be made thinner than an LCD panel. Furthermore, it is known that the liquid crystal molecules in an LCD panel have slower response time and an OLED display also offers higher viewing angles, a higher contrast ratio and higher electrical power efficiency than its LCD counterpart.

A typical LCD panel has a plurality of pixels arranged in a two-dimensional array, driven by a data driver and a gate driver. As shown in FIG. 1, the LCD pixels 5 in a LCD panel 1 are arranged in rows and columns in a display area 40. A data driver 20 is used to provide data signals to each of the columns and a gate driver 30 is used to provide a gate line signal to each of the rows. In a color display panel, an image is generally presented in three colors: red (R), green (G) and blue (B). Each of the pixels 5 is typically divided into three color sub-pixels: red sub-pixel, green sub-pixel and blue sub-pixel. In some color display panels, each of the pixels 5 also has a white (W) sub-pixel. Whether a pixel has three sub-pixels in RGB or four sub-pixels in RGBW, the data provided to each pixel has only three data signals in RGB.

SUMMARY OF THE INVENTION

The present invention provides a method and apparatus for converting three data signals in RGB to four data signals in RGBW to be used in an OLED wherein each pixel has three color sub-pixels and one W sub-pixel. In the conversion steps, input data are expanded by a mapping ratio between RGB color space and RGBW color space such that the expanded input data are within the RGBW gamut boundaries.

Thus, the first aspect of the present invention is a method for use in a display panel comprising a plurality of pixels, each pixel comprising a first sub-pixel, a second sub-pixel, a third sub-pixel and a fourth sub-pixel, said display panel arranged to receive a plurality of input signals for displaying an image thereon, and wherein said plurality of input signals are represented by N binary bits, with a maximum of the input signals equal to $(2^N-1)$ with N being a positive integer greater than 1, and wherein said plurality of input signals comprises a first input signal, a second input signal, and a third input signal, the method comprising:

converting the input signals into a plurality of input data in luminance space;

determining an adjustment value from the plurality of input data in luminance space; and computing a plurality of adjusted data values from the plurality of input data in luminance space and the adjustment value, the plurality of adjusted data values comprising a first adjusted data value, a second adjusted data value, a third adjusted data value and a fourth adjusted data value in luminance space for use in the pixel, each of the first, second and third adjusted data values corresponding to the first input signal, the second input signal and the third input signal, wherein the display panel has a color temperature characteristic such that when the plurality of adjusted data values are color-temperature corrected according to the color temperature characteristic for providing a plurality of color-temperature corrected data in luminance space, the color-temperature corrected data comprising a first corrected data for use in the first sub-pixel, a second corrected data for use in the second sub-pixel, a third corrected data for use in the third sub-pixel and a fourth corrected data for use in the fourth sub-pixel, the determining and computing are carried out in a manner such that, at least when each of the first input signal, the second input signal and the third input signal has a value of $(2^N-1)$, each of the first corrected data, the second corrected data, the third corrected data and fourth corrected data is smaller than or equal to 0.5.

The second aspect of the present invention is a processor for use in a display panel comprising a plurality of pixels, each pixel comprising a first sub-pixel, a second sub-pixel, a third sub-pixel and a fourth sub-pixel, said display panel arranged to receive a plurality of input signals for displaying an image thereon, and wherein said plurality of input signals are represented by N binary bits, with a maximum of the input signals equal to $(2^N-1)$ with N being a positive integer greater than 1, and wherein said plurality of input signals comprises a first input signal, a second input signal, and a third input signal, the processor comprising:

a converting block configured for converting the input signals into a plurality of input data in luminance space;

a level adjusting block configured for determining an adjustment value from the plurality of input data in luminance space; and a data adjustment block configured for computing a plurality of adjusted data values from the plurality of input data in luminance space and the adjustment value, the plurality of adjusted data values comprising a first adjusted data value, a second adjusted data value, a third adjusted data value and a fourth adjusted data value in luminance space for use in the pixel, each of the first, second and third adjusted data values corresponding to the first input signal, the second input signal and the third input signal, wherein the display panel has a color temperature characteristic such that when the plurality of adjusted data values are color-temperature corrected according to the color temperature characteristic for providing a plurality of color-temperature corrected data in luminance space, the color-temperature corrected data comprising a first corrected data for use in the first sub-pixel, a second corrected data for use in the second sub-pixel, a third corrected data for use in the third sub-pixel and a fourth corrected data for use in the fourth sub-pixel, wherein the adjustment value is determined such that at least when each of the first input signal, the second input signal and the third input signal has a value of $(2^N-1)$, each of the first corrected data, the second corrected data, the third corrected data and fourth corrected data is smaller than or equal to 0.5. The adjustment value is determined such that the fourth corrected data is smaller than or equal to any one of the first corrected data, the second corrected data and the third corrected data.

DETAILED DESCRIPTION OF THE INVENTION

The present invention is mainly concerned with converting three data signals in RGB to four data signals in RGBW for use in a color display. The conversion is carried out such that even when the RGB signals are of maximum values, each of the RGBW signals in the luminance space is equal to or smaller than 0.5 after the signals are corrected to suit the color temperature of the display.

Figure 1:
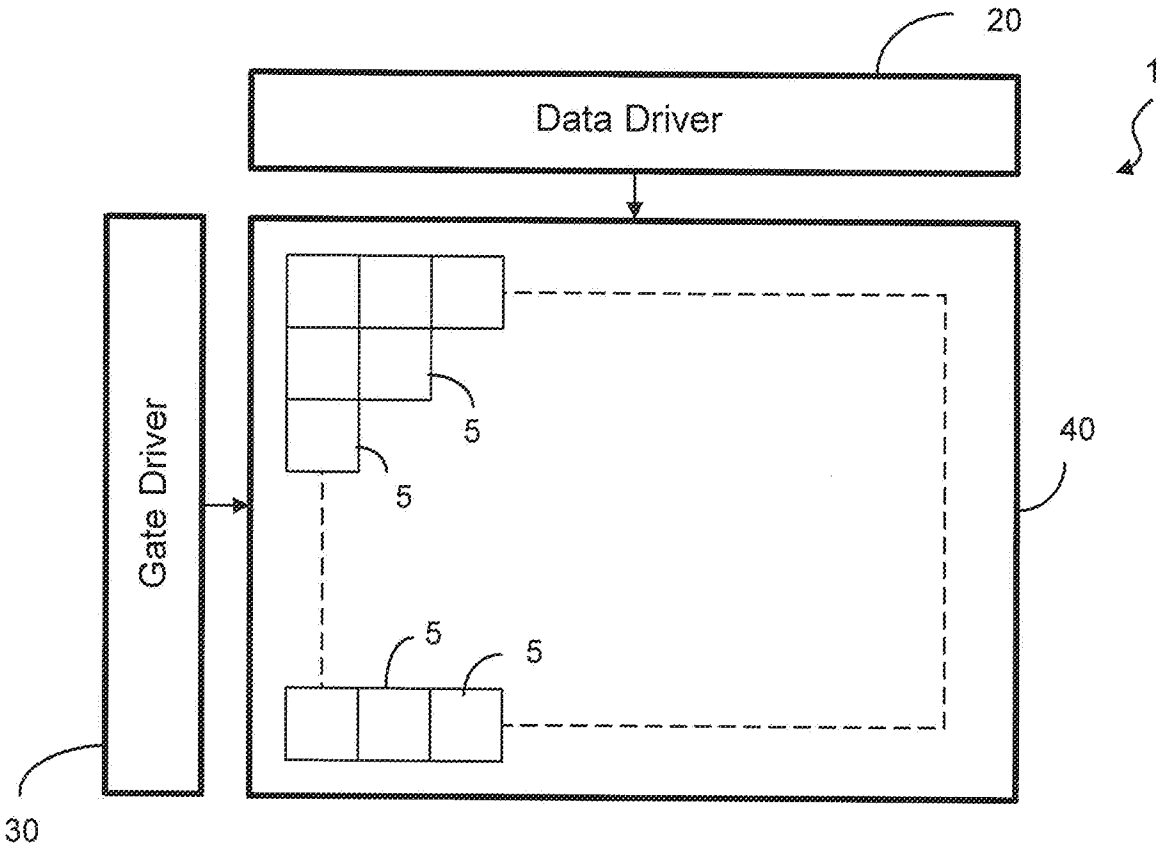
FIG. 1 (prior art)
FIG. 1 shows a typical display panel having rows and columns of pixels in a display area.
Figure 2:
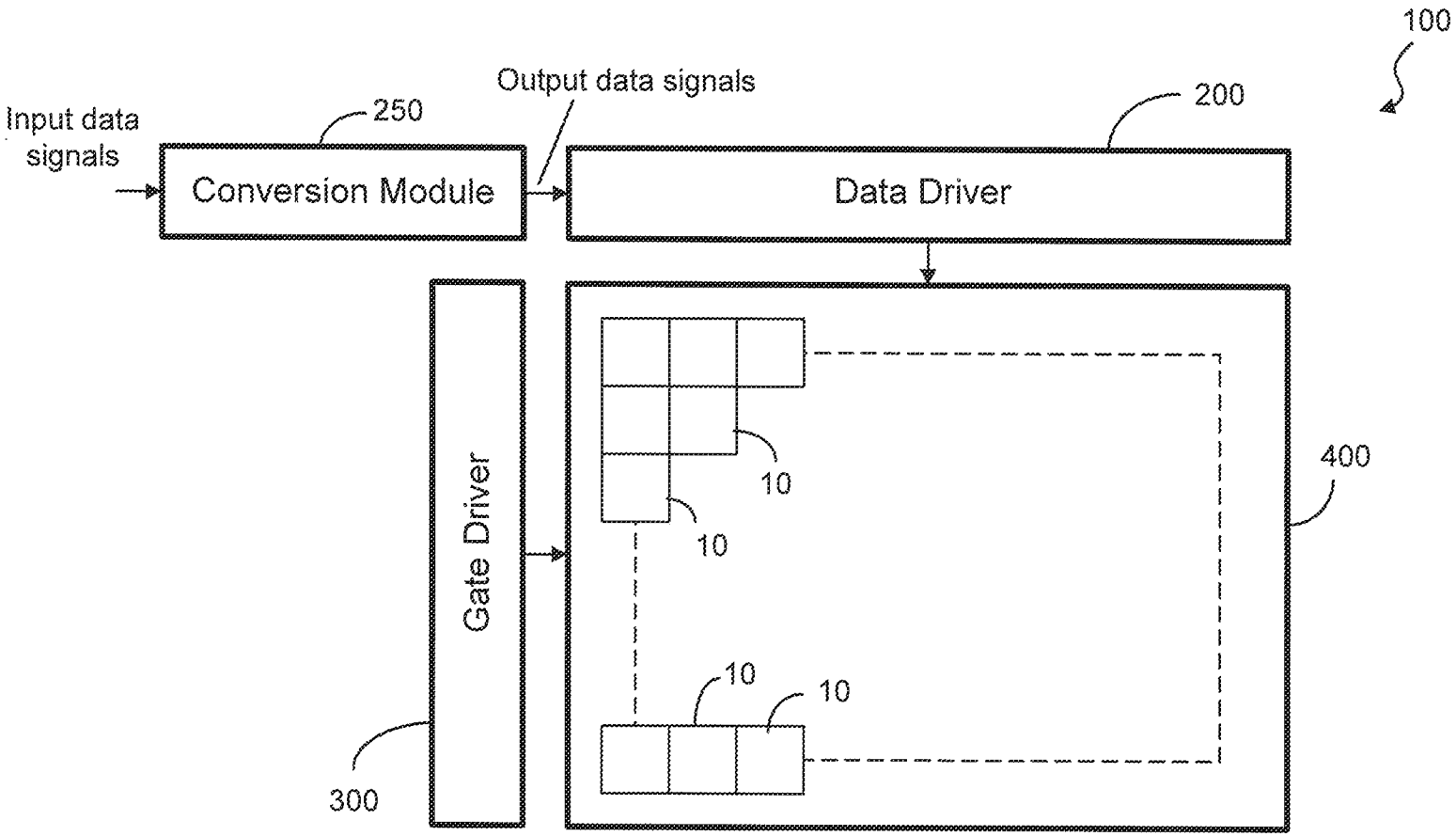
FIG. 2 shows a display panel according to various embodiments of the present invention.

The RGB to RGBW signal conversion scheme, according to various embodiments of the present invention, can be used in a variety of color displays, including an OLED display. FIG. 2 is a schematic representation of an OLED display, according to the present invention. As shown in FIG. 2, the OLED display 100 has a plurality of pixels 10 arranged in rows and columns in a display area 400. Each of the pixels has three color sub-pixels in RGB and one white (W) sub-pixel (see FIG. 3). A data driver 200 is used to provide data signals to the sub-pixels in each of the columns and a gate driver 300 is used to provide gate line signals to each of the rows. In order to provide four signal components in the data signals to the pixels, a conversion module 250 is used to convert data signals with three signal components to four signal components. The four signal components are then conveyed to the data driver 200.

Figure 3:
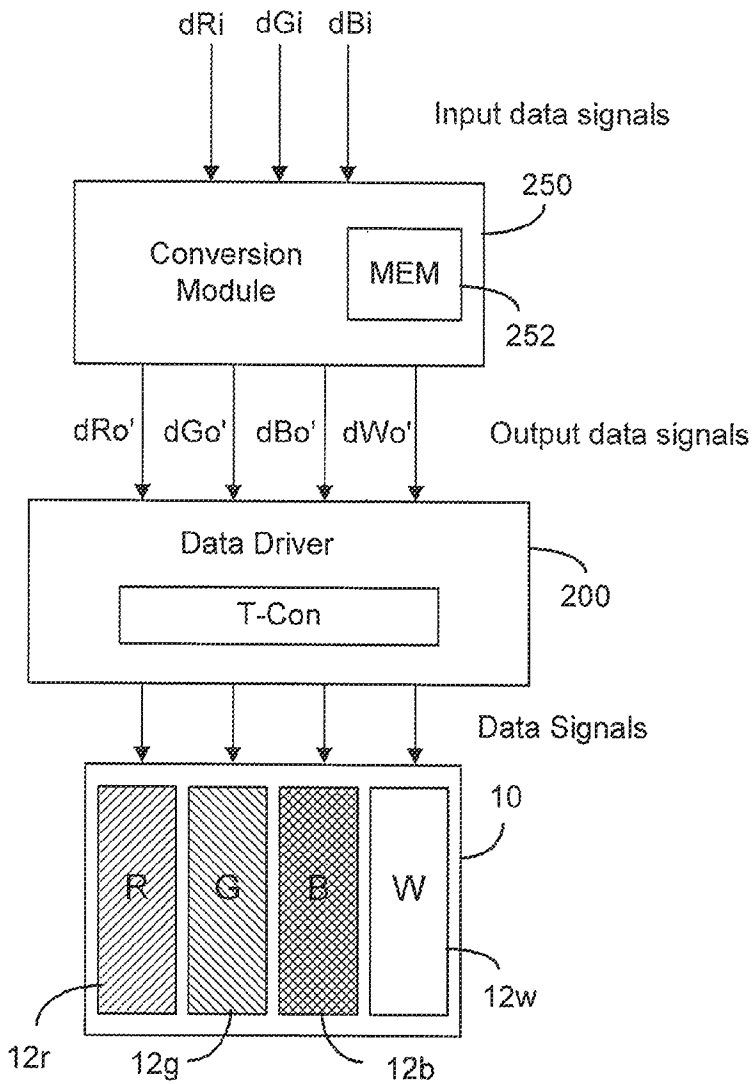
FIG. 3 shows input data signals in RGB converted into output data signals in RGBW, according to the present invention.
Figure 7:
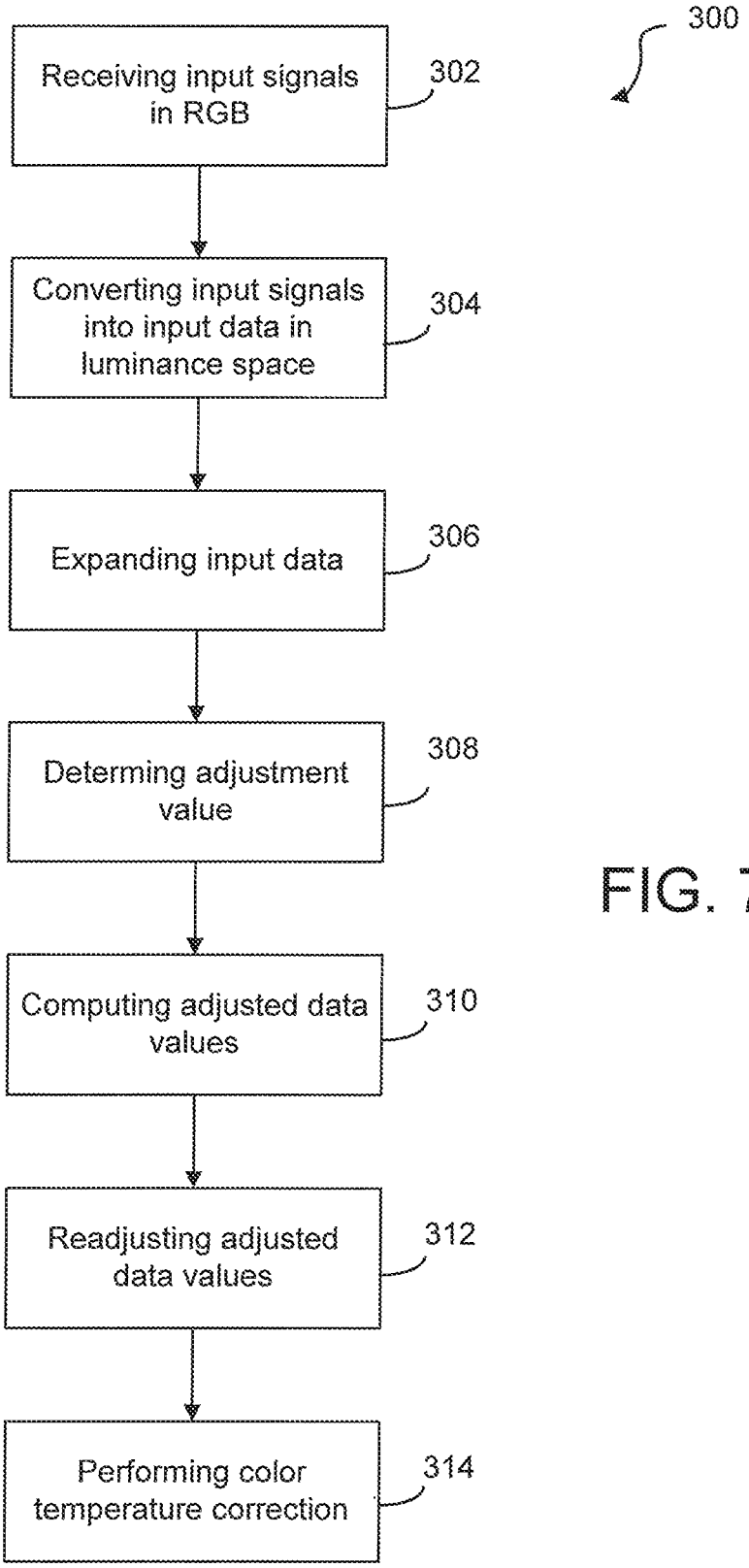
FIG. 7 is a flowchart illustrating the input signal conversion method, according to the present invention.

As shown in FIG. 3, the input data signals have three signal components in red, green and blue, or dRi, dGi, dBi. The conversion module 250 has a set of signal lines to receive the input data signals and another set of signal lines to provide the output data signals with four signal components to the data driver 200. The data driver 200 has a data-IC and a timing control (T-Con) arranged to output four signal components to each of pixels 10. The pixel 10 has four sub-pixels 12*r*, 12*g*, 12*b* and 12*w*. The output data signals, after color-temperature correction, have four signal components in red, green, blue and white, or dRo', dGo', dBo' and dWo'. The conversion module 250 can be a general electronic processor or a specific integrated circuit having hardware circuits to carry out the data signal conversion. Alternately, the conversion module 250 has a memory device 252. The memory device 252 can be a non-transitory computer readable medium having programming codes arranged to convert three signal components in the input data signals into four signal components in the output data signals. The algorithm in RGB to RGBW conversion carried out by the conversion module 250, either by the hardware circuit or by the software program, is illustrated in FIGS. 4*a* and 4*b*, and represented by the flowchart as shown in FIG. 7.

Figure 4A:
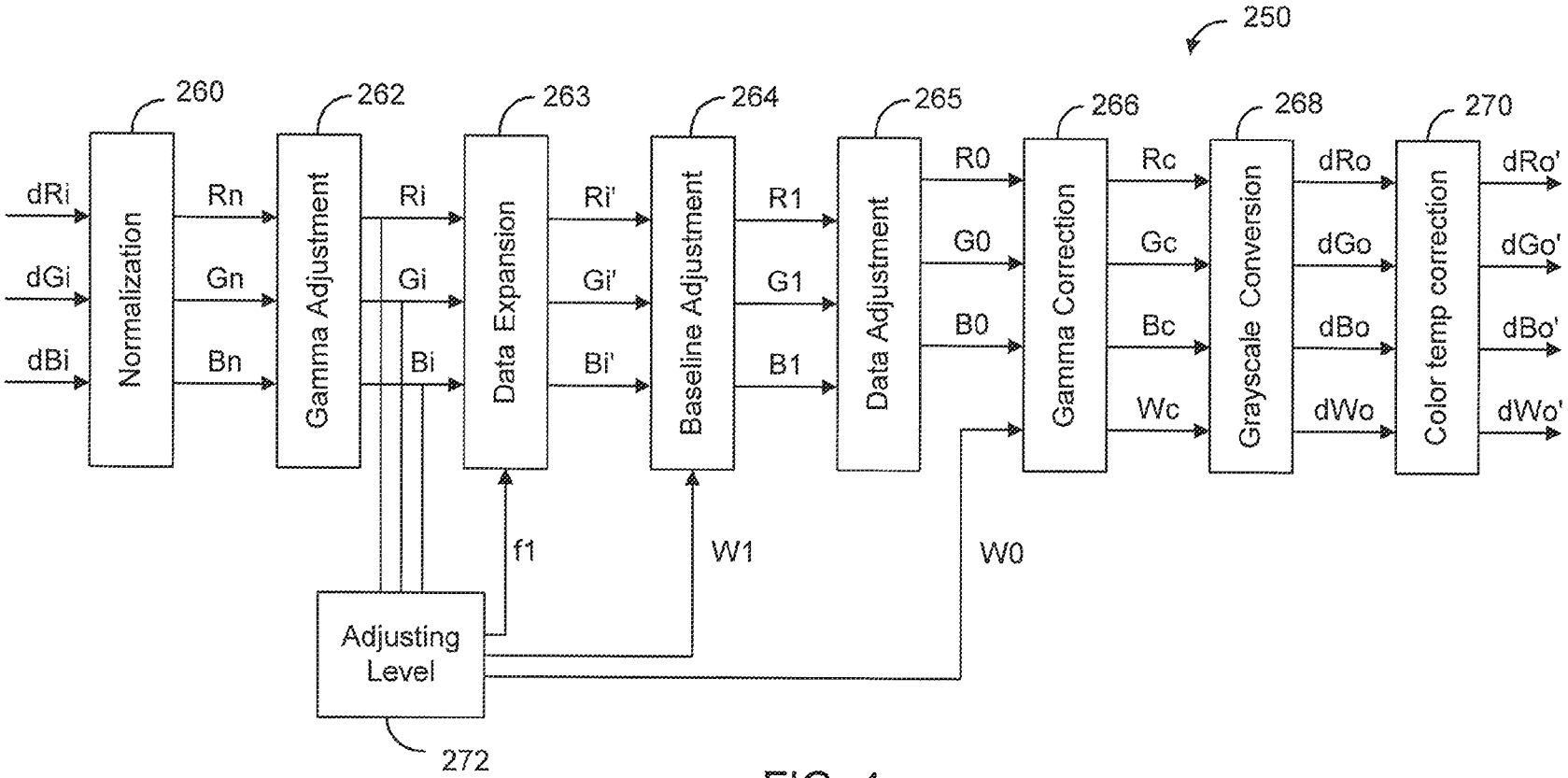
FIG. 4*a* shows a conversion module, according to one embodiment of the present invention.
Figure 4B:
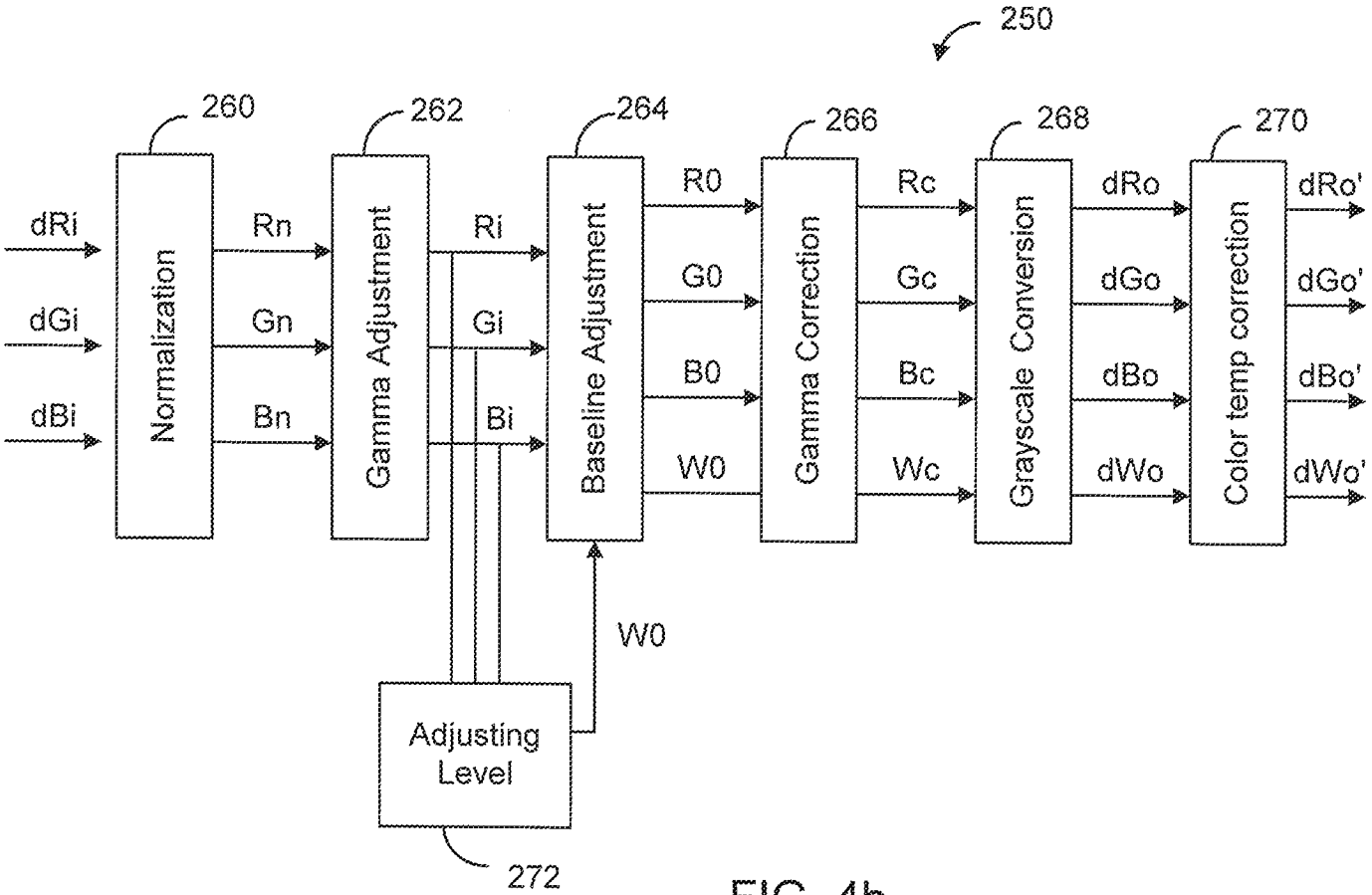
FIG. 4*b* shows a conversion module, according to another embodiment of the present invention.

FIG. 4*a* is block diagram showing various stages in RGB to RGBW conversion in a conversion module 250, according to one embodiment of the present invention. As shown in FIG. 4*a*, conversion module 250 has a normalization block 260 arranged to receive input data signals dRi, dGi, dBi and turn them into normalized input data [Rn, Gn, Bn] in signal space. The normalized input data [Rn, Gn, Bn] in signal space are then converted into input data in luminance space, or [Ri, Gi, Bi], by a gamma adjustment block 262. The gamma adjustment block 262 applies gamma expansion with a gamma of 2.2 on [Rn, Gn, Bn] for providing RGB data in luminance space or [Ri, Gi, Bi]. From [Ri, Gi, Bi], an adjusting level block 272 calculates a multiplication factor f1 and a baseline adjustment level W1 as follows:

First, a saturation value S is determined:

$$S=([Ri,Gi,Bi]\max-[Ri,Gi,Bi]\min)/[Ri,Gi,Bi]\max$$

If $S<0.5$, we define $V'\max=2$. If $S\geq 0.5$, $V'\max=1/S$.

Second, the multiplication factor f1 is determined as $$f1=V'\max/[Ri,Gi,Bi]\max$$

Third, the baseline adjustment level W1 is determined as $$W1=f1\times[Ri,Gi,Bi]\min/2, \text{ or}$$

$$W1=f1\times[Ri,Gi,Bi]\max/2.$$

Figure 4C:
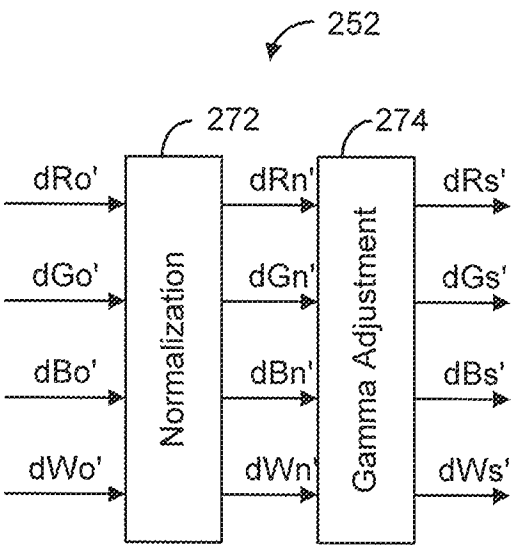
FIG. 4*c* shows an additional module, according to a different embodiment of the present invention.
Figure 4D:
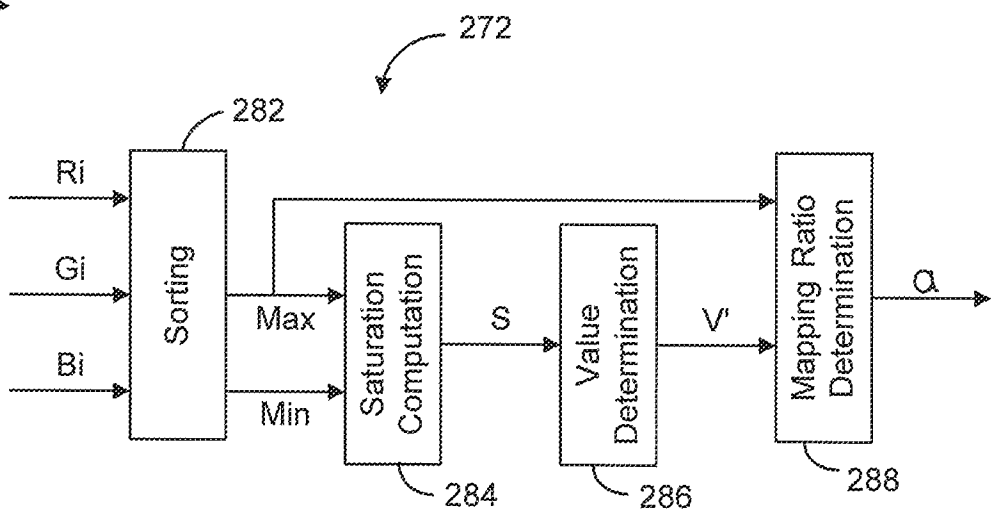
FIG. 4*d* shows a data expansion block, according to one embodiment of the present invention.

An example of the adjustment level block 272 is shown in FIG. 4*d*.

A data expansion block 263 is then used to expand RGB data in luminance space or [Ri, Gi, Bi] by multiplying these values by f1, or $$[Ri',Gi',Bi']=f1\times[Ri,Gi,Bi]$$

A baseline adjustment block 264 computes the baseline adjusted data [R1, G1, B1] based on the baseline adjustment level W1:

$$[R1,G1,B1]=[Ri',Gi',Bi']-W1$$

The baseline adjustment level W1 is also used to compute the white data in luminance space or $$W0=W1/f1$$

The baseline adjusted data [R1, G1, B1] are adjusted by a factor f2 by a data adjustment block 265 to become $$[R0,G0,B0]=[R1,G1,B1]/f2$$

The adjustment factor f2 is chosen from a range $0<f2\leq f1$ such that W0 is equal to or smaller than [R1, G1, B1] min/f2.

The four components of the adjusted data in luminance space [R0, G0, B0, W0] are then processed by a gamma correction block 266 into adjusted data in signal space as:

$$[Rc,Gc,Bc,Wc]=[R0,G0,B0,W0]^{1/2.2}$$

After gray-scale conversion by block 266, we obtain four signal components in the output data signals, or $$[dRo,dGo,dBo,dWo]=[Rc,Gc,Bc,Wc]\times 255$$

In one embodiment of the present invention, the four signal components [dRo, dGo, dBo, dWo] are also corrected for their color temperature using a look-up table (LUT) into color-temperature corrected data [dRo', dGo', dBo', dWo']:

$$[dRo',dGo',dBo',dWo']=[dRo,dGo,dBo,dWo]^{*}\ (\text{RGBW-LUT})$$

The color temperature is based on the color temperature characteristics of the display panel. In general, color temperatures are color dependent. The color temperature for a green signal component may not be the same as the color temperature for a red signal component even when the green signal component and the red signal component are equal.

The adjustment factor f2 associated with data adjustment block 265 can be chosen from a range 0<f2≤f1. If f2 is chosen to be equal to f1, then the data expansion block 263 and the data adjustment block 265 as shown in FIG. 4*a* can be omitted. As such, the conversion module 250 can be represented by that shown in FIG. 4*b*. Furthermore, in order to show that even when the input RGB signals are of maximum values, each of the output RGBW signals in the luminance space is equal to or smaller than 0.5. An additional conversion module 252 is used to convert the four signal components dRo', dGo', dBo' and dWo' in signal space into four data components dRs', dGs', dBs' and dWs', as shown in FIG. 4*c*.

As shown in FIG. 4*c*, the color-temperature corrected data [dRo', dGo', dBo', dWo'] in signal space are normalized by the normalization block 272 into normalized data [dRn', dGn', dBn', dWn']. A gamma adjustment block 274 applies gamma expansion with a gamma of 2.2 on [dRn', dGn', dBn', dWn'] for providing the color-temperature corrected data in luminance space, or [dRs', dGs', dBs', dWs']. It can be shown that, when the input signals [dRi, dGi, dBi] (see FIGS. 4*a* and 4*b*) are of their maximum values, or [255, 255, 255], each of the color-temperature corrected data in luminance space [dRs', dGs', dBs', dWs'] has a value within the range of (0.4/k) and (0.5/k), where k is the ratio of the area of the W sub-pixel to the area of an RGB sub-pixel, or $$(0.4/k)\le dRs'\le(0.5/k);$$

$$(0.4/k)\le dGs'\le(0.5/k);$$

$$(0.4/k)\le dBs'\le(0.5/k);$$

$$(0.4/k)\le dWs'\le(0.5/k).$$

In various embodiments of the present invention, the multiplication factor f1 is determined based on a saturation value S and [Ri, Gi, Bi]max (see Examples 1-3 below). The multiplication factor f1 is computed using an adjusting level block 272. An example of the adjusting level block 272 is shown in FIG. 4*d*. The adjusting level block 272 can be a hard-wired processor or a processor having a software program to carry out various processing steps. As shown in FIG. 4*d*, the adjusting level block 272 comprises a sorting module 282 to sort out the maximum value of [Ri, Gi, Bi] and the minimum value of [Ri, Gi, Bi] and convey [Ri, Gi, Bi]max and [Ri, Gi, Bi]min to a saturation computation module 284 which determines S as follows:

$$S=([Ri,Gi,Bi]\max-[Ri,Gi,Bi]\min)/[Ri,Gi,Bi]\max$$

The saturation S is provided to a value determination module 286 to compute a value V'max as follows:

$$\text{If } S<0.5,\ V'\max=2.\ \text{If } S\ge 0.5,\ V'\max=1/S.$$

Based on the value V'max, a mapping ratio α is computed by a mapping ratio determination module 288:

$$\alpha=V'\max/[Ri,Gi,Bi]\max$$

In some embodiments of the present invention, the multiplication factor is the same as the mapping ratio α, or f1=V'max/[Ri, Gi, Bi]max. Based on the multiplication factor f1 and [Ri, Gi, Bi], the baseline adjustment value W1 is determined.

Figure 4E:
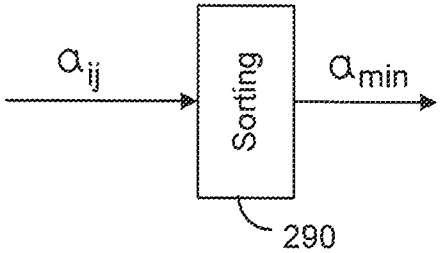
FIG. 4*e* illustrates a sorting module for use in determining a mapping ratio, according to one embodiment of the present invention.

In a different embodiment of the present invention, the multiplication factor f1 is determined by a quantity called $\alpha_{final}$, which is the smallest value of the mapping ratio of all pixels in a selected portion of an image. In order to determine the smallest mapping ratio in an image portion, a sorting module 290 as shown in FIG. 4*e* is used, for example. As shown in FIG. 4*e*, $\alpha_{ij}$ represents the mapping ratio as determined by S, V'max and the maximum value of input data [Ri, Gi, Bi] provided to a pixel. Once a portion of an image is selected for $\alpha_{final}$ determination, the mapping ratio α for each of the pixels in the image portion is provided to the sorting module 290 for sorting. How the sorting is carried out is described in conjunction with FIGS. 8*a* to 8*c*.

Example 1

To illustrate the conversion algorithm according to the embodiment as shown in FIG. 4*a*, we select a set of maximum input signals or [dRi, dGi, dBi]=[255, 255, 255]. Here it is assumed that the input signals are represented by N binary bits with N=8 and $255=(2^N-1)$.

After normalization by the normalization block 260, we have $$[Rn,Gn,Bn]=[255,255,255]/255=[1,1,1].$$

The gamma adjustment block 262 applies gamma expansion with a gamma of 2.2 on [Rn, Gn, Bn] for providing RGB data in luminance space or $$[Ri,Gi,Bi]=[1,1,1]^{2.2}=[1,1,1]$$

From [Ri, Gi, Bi], an adjusting level block 272 calculates a multiplication factor f1 and a baseline adjustment level W1 as follows:

$$\begin{aligned} S &= ([Ri,\ Gi,\ Bi]\max-[Ri,\ Gi,\ Bi]\min)/[Ri,\ Gi,\ Bi]\max \\ &= (1-1)/1 \\ &= 0. \end{aligned}$$

Since S=0<0.5, we have V'max=2.

The multiplication factor f1 is determined as $$f1=V'\max/1=2$$

The baseline adjustment level W1 is determined as $$W1=f1\times[Ri,Gi,Bi]\min/2 \text{ or } f1\times[Ri,Gi,Bi]\max/2=2\times ½=1$$

A data expansion block 263 is then used to expand RGB data in luminance space or [Ri, Gi, Bi] by multiplying these values by f1, or $$[Ri', Gi', Bi'] = f1 \times [1, 1, 1] = 2 \times [1, 1, 1] = [2, 2, 2]$$

A baseline adjustment block 264 computes the baseline adjusted data [R1, G1, B1] based on the baseline adjustment level W1:

$$[R1, G1, B1] = [Ri', G', Bi'] - W1 = [2, 2, 2] - 1 = [1, 1, 1]$$

The baseline adjustment level W1 is also used to compute the white data in luminance space or $$W0 = W1/f1 = ½ = 0.5$$

The baseline adjusted data [R1, G1, B1] are adjusted by a factor f2 by a data adjustment block 265 to become $$[R0, G0, B0] = [R1, G1, B1]/f2 = [1,1,1]/f2$$

The adjustment factor f2 is chosen from a range 0<f2≤f1. If we choose f2=f1=2 and we have $$[R0, G0, B0] = [1,1,1]/2 = [0.5, 0.5, 0.5].$$

The four components of the adjusted data in luminance space [R0, G0, B0, W0] are then processed by a gamma correction block 266 into adjusted data in signal space as:

$$[Rc, Gc, Bc, Wc] = [R0, G0, B0, W0]^{1/2.2} = [0.5, 0.5, 0.5, 0.5]^{1/2.2} = [0.73, 0.73, 0.73, 0.73]$$

After gray-scale conversion by block 266, we obtain four signal components in the output data signals, or $$[dRo, dGo, dBo, dWo] = [Rc, Gc, Bc, Wc] \times 255 = [0.73, 0.73, 0.73, 0.73] \times 255 = [186, 186, 186, 186]$$

Using a look-up table, the color temperatures for [dRo, dGo, dBo, dWo] are:

$$[dRo, dGo, dBo, dWo]*(\text{RGBW-LUT}) = [186, 186, 186, 186]*(\text{RGBW-LUT})$$

The color temperature adjustment is based on the color temperature characteristics of a display panel. The look-up table (LUT) only represents a way to make a displayed picture appear on the display. For illustration purposes only, let us assume that the color temperatures responding to the data signals [186, 186, 186, 186] are [2899, 2698, 2981, 2698].

After standardizing the color-temperatures in reference to 4095, and adjusting the results within the range of 0-255, we have the output data in signal space from the conversion module 250:

$$[dRo', dGo', dBo', dWo'] = \{[2899, 2698, 2981, 2698]/4095\} \times 255 = [0.708, 0.659, 0.728, 0.659] \times 255 = [180, 168, 186, 168]$$

The same output data in luminance space would be $$[dRs', dGs', dBs', dWs'] = [0.708, 0.659, 0.728, 0.659]^{2.2} = [0.468, 0.400, 0.498, 0.400]$$

With k=1, we have $$0.4/k \le [dRs', dGs', dBs', dWs'] \le 0.5/k$$

$$dWs' \le [dRs', dGs', dBs']\text{min}$$

Example 2

To illustrate how different input signals in RGB are converted into four signal components [dRo, dGo, dBo, dWo], we select [dRi, dGi, dBi]=[251, 203, 186].

After normalization by the normalization block 260, we have $$[Rn, Gn, Bn] = [251, 203, 186]/255 = [0.984, 0.796, 0.729].$$

The gamma adjustment block 262 applies gamma expansion with a gamma of 2.2 on [Rn, Gn, Bn] for providing RGB data in luminance space or $$[Ri, Gi, Bi] = [0.984, 0.796, 0.729]^{2.2} = [0.966, 0.605, 0.500].$$

From [Ri, Gi, Bi], an adjusting level block 272 calculates a multiplication factor f1 and a baseline adjustment level W1 as follows:

$$S = ([Ri, Gi, Bi]\text{max} - [Ri, Gi, Bi]\text{min})/[Ri, Gi, Bi]\text{max} = (0.966 - 0.500)/0.966 = 0.466/0.966 = 0.482.$$

If S<0.5, we set V'max=2. If S≥0.5, V'max=1/S.

Since S=0.482<0.5, we have V'max=2.

The multiplication factor f1 is determined as $$f1 = V'\text{max}/[Ri, Gi, Bi]\text{max} = 2/0.966 = 2.070$$

The baseline adjustment level W1 is determined as $$W1 = f1 \times [Ri, Gi, Bi]\text{min}/2 = 2.070 \times 0.500/2 = 0.517$$

A data expansion block 263 is then used to expand RGB data in luminance space or [Ri, Gi, Bi] by multiplying these values by f1, or $$[Ri', Gi', Bi'] = f1 \times [Ri, Gi, Bi] = 2.070 \times [0.966, 0.605, 0.500] = [2.000, 1.252, 1.035]$$

A baseline adjustment block 264 computes the baseline adjusted data [R1, G1, B1] based on the baseline adjustment level W1:

$$[R1, G1, B1] = [Ri', Gi', Bi'] - W1$$
$$= [2.000, 1.252, 1.035] - 0.517$$
$$= [1.483, 0.735, 0.517]$$

The baseline adjustment level W1 is also used to compute the white data in luminance space or $$W0 = W1/f1 = 0.517/2.070 = 0.250$$

The baseline adjusted data [R1, G1, B1] are adjusted by a factor f2 by a data adjustment block 265 to become $$[R0, G0, B0] = [R1, G1, B1]/f2 = [1.483, 0.735, 0.517]/f2$$

The adjustment factor f2 is chosen from a range 0<f2≤f1 such that W0 must be equal to or smaller than [R1, G1, B1]min/2. In this example, f2 can be chosen as being equal to f1, such that $$[R0, G0, B0] = [1.483, 0.735, 0.517]/2.070 = [0.716, 0.355, 0.250].$$

The four components of the adjusted data in luminance space [R0, G0, B0, W0] are then processed by a gamma correction block 266 into adjusted data in signal space as:

$$[Rc, Gc, Bc, Wc] = [R0, G0, B0, W0]^{1/2.2}$$
$$= [0.716, 0.355, 0.250, 0250]^{1/2.2}$$
$$= [0.859, 0.624, 0.532, 0.532]$$

After gray-scale conversion by block 266, we obtain four signal components in the output data signals, or $$[dRo, dGo, dBo, dWo] = [Rc, Gc, Bc, Wc] \times 255$$
$$= [0.859, 0.624, 0.532, 0.532] \times 255$$
$$= [219, 159, 136, 136]$$

OTHER EMBODIMENTS

As mentioned earlier, the baseline adjustment level W1 can be determined by $$W1 = f1 \times [Ri, Gi, Bi]\text{min}/2 \text{ or by}$$

$$W1 = f1 \times [Ri, Gi, Bi]\text{max}/2.$$

If the input signals are the maximum values or [dRi, dGi, dBi]=[255, 255, 255](see Example 1), then [Ri, Gi, Bi]min and [Ri, Gi, Bi]max are the same. Thus, whether W1 is determined based on [Ri, Gi, Bi]min or [Ri, Gi, Bi]max, the result is the same. However, if the input signals are not the maximum values, [Ri, Gi, Bi]min and [Ri, Gi, Bi]max are not the same. Thus, the baseline adjustment level is affected by how W1 is determined.

In Example 2 above, [dRi, dGi, dBi]=[251, 203, 186] and the RGB data in luminance space are [Ri, Gi, Bi]=[0.966, 0.605, 0.500]. The multiplication factor is determined as $$f1 = V'\text{max}/[Ri, Gi, Bi]\text{max} = 2/0.966 = 2.070.$$

It is followed that W1=f1×[Ri, Gi, Bi]min/2 or W1=0.517. The four signal components in the output data signals are $$[dRo, dGo, dBo, dWo] = [219, 159, 136, 136]$$

Example 3

In a different embodiment of the present invention, the baseline adjustment level W1 is determined based on [Ri, Gi, Bi]max:

$$W1 = f1 \times [Ri, Gi, Bi]\text{max}/2$$
$$= 2.070 \times 0.966/2$$
$$= 1.0$$

For simplicity, we select f2=f1, or the data expansion block 263 and the data adjustment block 265 (see FIG. 4*a*) are omitted and the conversion steps are carried out in the conversion module 250 as shown in FIG. 4*b*.

In that case, we have two situations:

1. If [Ri, Gi, Bi]min≥[Ri, Gi, Bi]max/2, then
   W0=[Ri, Gi, Bi]max/2;
   [R0, G0, R0]=[Ri, Gi, Bi]−W0
2. If [Ri, Gi, Bi]min<[Ri, Gi, Bi]max/2, then
   W0=[Ri, Gi, Bi]max/2+[Ri, Gi, Bi]min
   [R0, G0, R0]=[Ri, Gi, Bi]−W0

To illustrate how this embodiment is carried out, we select [dRi, dGi, dBi]=[255, 255, 224]. After normalization and gamma adjustment, we obtain $$[Ri, Gi, Bi] = \{[255, 255, 224]/255\}^{2.2} = [1, 1, 0.878]^{2.2} = [1, 1, 0.752].$$

In this case, [Ri, Gi, Bi]min=0.991 and [Ri, Gi, Bi]max/2=0.5. We have $$W0 = 0.5$$
$$[R0, G0, R0] = [Ri, Gi, Bi] - W0 = [0.5, 0.5, 0.252, 0.5]$$
$$[Rc, Gc, Bc, Wc] = [0.5, 0.5, 0.252, 0.5]^{1/2.2}$$
$$= [0.730, 0.730, 0.534, 0.730]$$
$$[dRo, dGo, dBo, dWo] = [Rc, Gc, Bc, Wc] \times 255 = [186, 186, 136, 186]$$

Example 4

In the pixel design where the ratio of the area of the W sub-pixel to the area of an RGB sub-pixel is k, we have two situations:

1. If [Ri, Gi, Bi]min≥k×[Ri, Gi, Bi]max/(1+k), then
   W0=[Ri, Gi, Bi]max/(1+k)
   [R0, G0, B0]=[Ri, Gi, Bi]−k×W0.
2. If [Ri, Gi, Bi]min<k×[Ri, Gi, Bi]max/(1+k), then
   W0=[Ri, Gi, Bi]max/(1+k)+[Ri, Gi, Bi]min/k
   [R0, G0, R0]=[Ri, Gi, Bi]−k×W0

Example 5

In a different embodiment of the present invention, the multiplication factor f1 is determined from a plot of [Ri, Gi, Bi]max/V'max for all pixels in an image portion. As defined earlier, V'max is determined from the saturation value S:

$$S = ([Ri, Gi, Bi]\text{max} - [Ri, Gi, Bi]\text{min})/[Ri, Gi, Bi]\text{max}$$

If $S<0.5$, $V'\text{max}=2$. If $S\geq 0.5$, $V'\text{max}=1/S$.

Figure 8A:
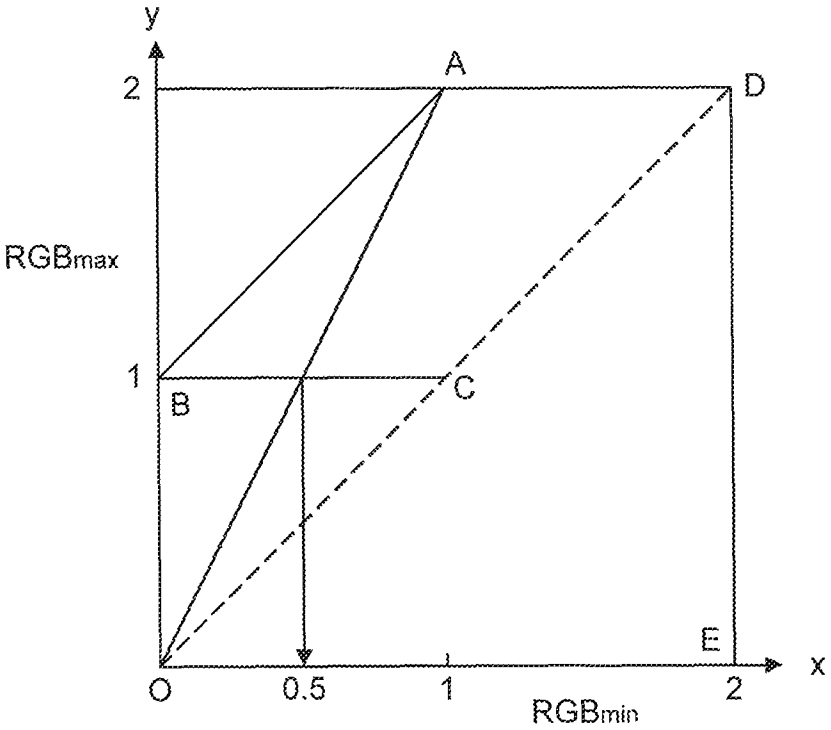
FIG. 8*a* shows the relationship between the RGB gamut boundary and the RGBW gamut boundary.
Figure 8B:
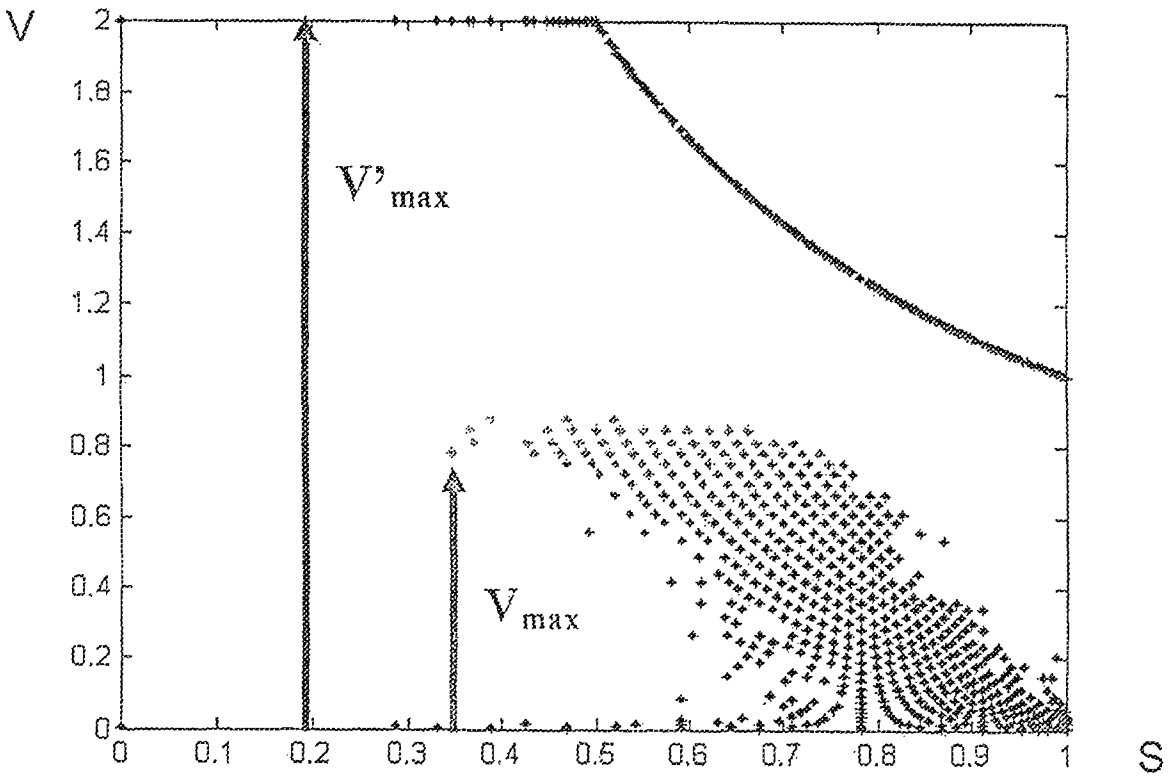
FIG. 8*b* shows a plot of Value vs. Saturation for determining the mapping ratio of a plurality of input data.
Figure 8C:
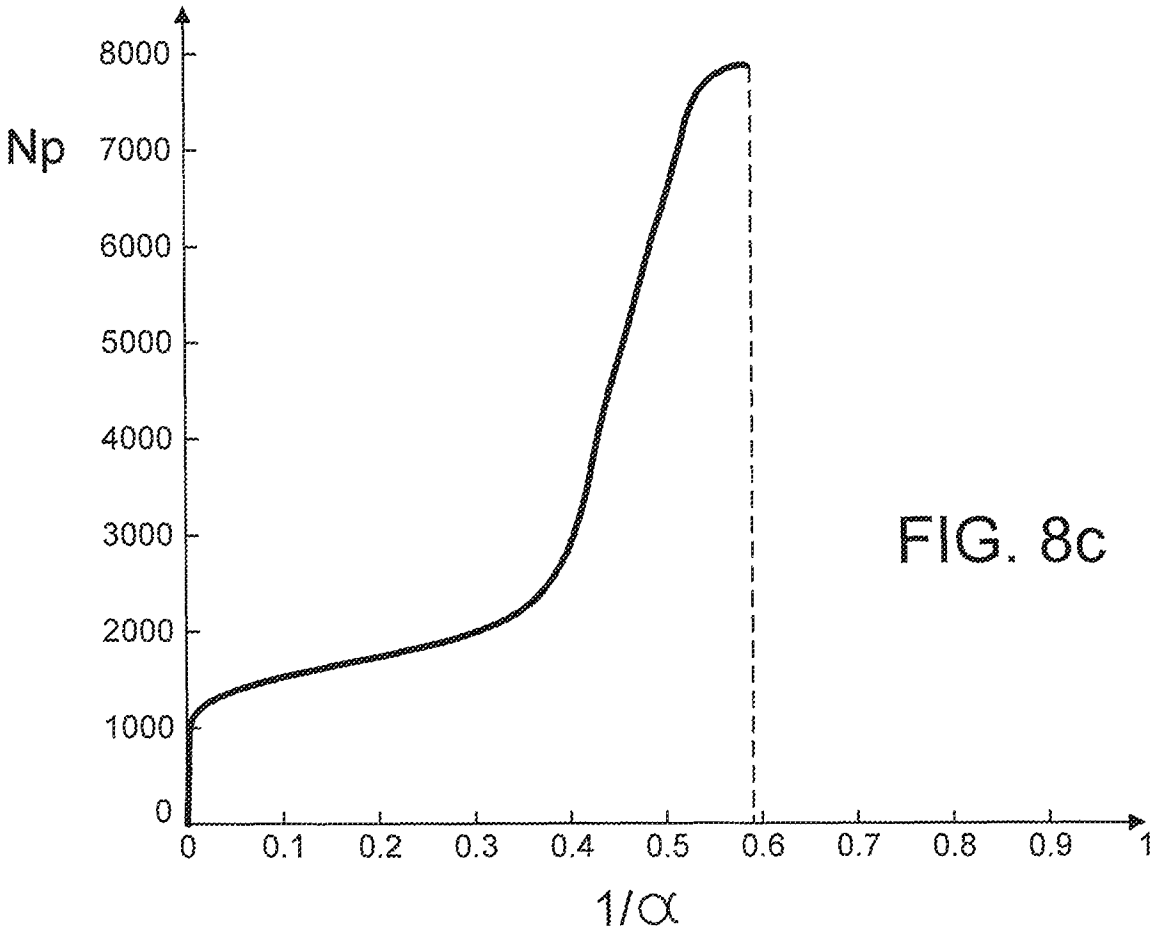
FIG. 8*c* shows a plot for determining a final mapping ratio, according to one embodiment of the present invention.

Let us define Q=[Ri, Gi, Bi]max/V'max, with $0<Q\leq 1$, and sort out the maximum value of Q among the pixels, we have f1=1/Qmax. The sorting can be carried out in a hard-wired circuit such as an ASIC, or carried out using a software program implemented in a generic processor, a memory device or a computing device. The value 1/Qmax is also referred to as $\alpha_{final}$. FIGS. 8*a* to 8*c* illustrate how $\alpha_{final}$ is determined.

With a pixel having maximum data values of [1, 1, 1], we have V'max=2 and Q=0.5; with a pixel having data values of [1, 1, 0], we have V'max=1 and Q=1.

Figure 6:
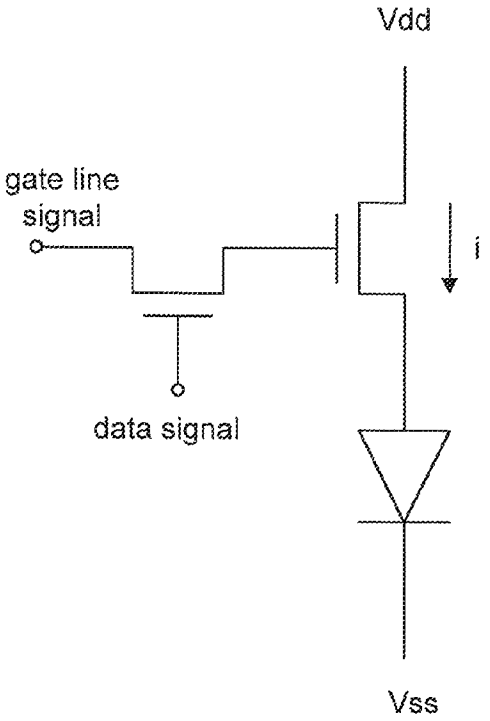
FIG. 6 shows a typical switching circuit in a sub-pixel.
Figure 5B:
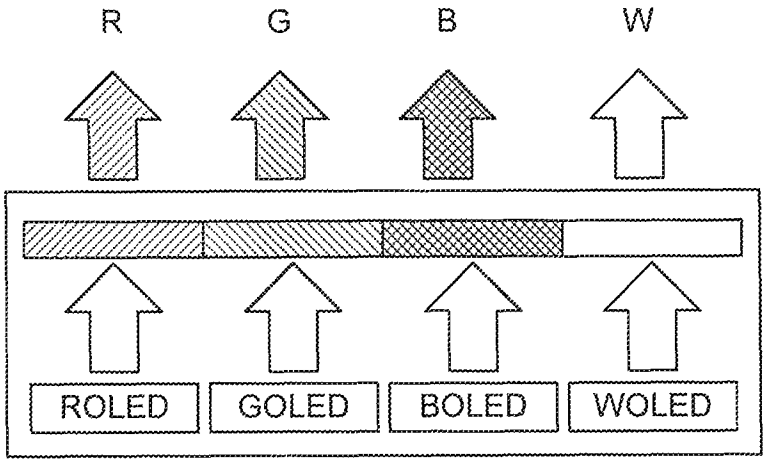
FIG. 5*b* shows a pixel having four sub-pixels in an OLED display panel, according to another embodiment of the present invention.
Figure 5A:
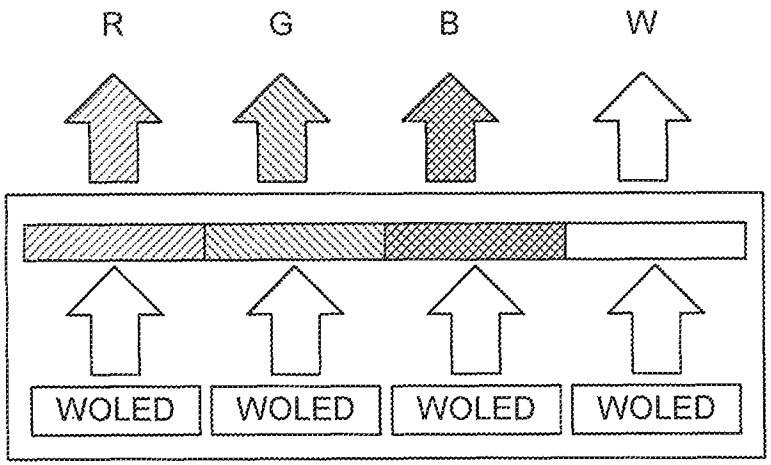
FIG. 5*a* shows a pixel having four sub-pixels in an OLED display panel, according to one embodiment of the present invention.

The various embodiments of the present invention can be used in a display panel having a plurality of pixels, wherein each pixel has four sub-pixels. For example, a color pixel in an OLED display may have one red OLED, one blue OLED, one green OLED and one white OLED to form four different color sub-pixels as shown in FIG. 5*b*. Alternatively, a color pixel may have four white OLEDs to form four color sub-pixels through color-filtering as shown in FIG. 5*a*. It is understood that each of the OLEDs is typically driven by a current source as shown in FIG. 6.

In summary, the present invention provides a conversion algorithm for converting three data signals in RGB to four data signals in RGBW. After the four data signals in RGBW in luminance space, [R0, G0, R0, W0], are adjusted based on the color temperature characteristics of the display, the color-temperature corrected data [dRo', dGo', dBo', dWo'] is in the range of 0.8 to 1.0 of [R0, G0, R0, W0]. In particular, the three data signals in RGB are received as input signals represented by N binary bits, with a maximum of the input signals equal to $(2^N-1)$. The conversion algorithm comprises the steps as shown in FIG. 7. As shown in a flowchart 300 in FIG. 7, the input signals in RGB (in signal space) are received at step 302. The input signals in signal space are converted into input data in luminance space at step 304. The input data in luminance space are then expanded at step 306. After input data expansion, an adjustment value is determined at step 308 and the adjustment value is used to compute adjusted data values (baseline adjusted data) at step 310. It is followed that the adjusted data values are re-adjusted at step 312. The re-adjusted data values are corrected for color-temperature at step 314. The color-temperature corrected data are then applied to the four color sub-pixels in the display. In some embodiments of the present invention, steps 306 and 312 are optional and can be omitted together. If step 306 is used to expand the input data, a multiplication factor is determined based on a saturation value S and the maximum value of the input data in luminance space. The non-zero adjustment factor that is used to re-adjust the adjusted data values at step 312 can be equal to or smaller than the multiplication factor. The adjustment value can be determined from the minimal value or the maximum value of the input data in luminance space.

According to one embodiment of the present invention, the multiplication factor that is used to expand the input data is determined based on the saturation S and the maximum value of the input data in luminance space for a pixel (see Examples 1 and 2). According to another embodiment of the present invention, the multiplication factor is determined based on the saturation S and the maximum value of the input data in luminance space for a plurality of pixels in a selected portion of an image (see Example 5). In this embodiment, the multiplication factor is determined by a quality called $\alpha_{final}$. The reason for using $\alpha_{final}$ is to make sure that, after the input data in luminance space are expanded by the data expansion block 263 (see FIG. 4*a*), the data [Ri', Gi', Bi'] remain within the RGBW gamut boundaries.

In order to correctly map the input data [Ri, Gi, Bi] in RGB color space to [R1, G1, B1, W1] in RGBW color space, we establish the RGBW gamut boundaries based on the assumption that the sum of RGB luminance is equal to W luminance and, therefore, the total luminance in a pixel resulting from [R1, G1, B1, W1] is equal to two times the total luminance in the pixel resulting from [Ri, Gi, Bi]. The relationship between the RGBW gamut boundaries and the RGB gamut boundaries can be found in a plot of [Ri, Gi, Bi]max vs. [Ri, Gi, Bi]min as shown in FIG. 8*a*. In FIG. 8*a*, the triangle OBC defines the RGB gamut boundaries and the trapezoid OBAD defines the RGBW gamut boundaries. The side BA of the trapezoid in FIG. 8*a* can be expressed as $$y=[Ri,Gi,Bi]\max/\{[Ri,Gi,Bi]\max-[Ri,Gi,Bi]\min\}=1/S$$

Thus, the line segments BAD represent the upper RGBW gamut boundaries. In order to determine the multiplication factor f1, we select the input data [Ri, Gi, Bi] provided to an image portion and plot the maximum value, or [Ri, Gi, Bi]max, for each of the input data in the selected image portion in the SV plane of HSV color space (H, S, V represent Hue, Saturation and Value) as shown in FIG. 8*b*. In FIG. 8*b*, Vmax is the value [Ri, Gi, Bi]max of an input data in RGB color space and V'max is the corresponding value [Ri', Gi', Bi']max in RGBW color space. For each pixel in the selected image portion, we define a mapping ratio $\alpha$=V'max/Vmax. As can be seen in FIG. 8*b*, when S is smaller than 0.5, V'max is always equal to 2. When S is between 0.5 and 1, V'max=1/S. The reciprocal of the mapping ratio, or $1/\alpha$, can be as small as 0 (with Vmax=0) and as large as 1 (with Vmax=1 and V'max=1), depending on the input data in a certain image portion. With the input data as shown in FIG. 8*b*, V'max is greater than Vmax and $1/\alpha$ is smaller than 1. To determine the smallest mapping ratio $\alpha$ among all the input data values, we arrange the values of $1/\alpha$ in a plot of pixel number vs. S as shown in FIG. 8*c*. As shown in FIG. 8*c*, the largest $1/\alpha$ is approximately 0.59. We refer this mapping ratio to as $\alpha_{final}$ and use it as the multiplication factor f1 for all of the input data in the selected image portion. As such, the expanded input data [Ri', Gi', Bi'] will be within the RGBW gamut boundaries.

The embodiments disclosed herein are concerned with a method and apparatus for converting three data signals in RGB to four data signals in RGBW for use in an OLED display. In an RGBW OLED display, the additional W sub-pixels can significantly increase the transmissivity of an OLED panel and decrease the power consumption of the display so as to increase the lifetime of OLEDs.

Although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. A method for use in a display panel comprising a plurality of pixels, each pixel comprising a first sub-pixel, a second sub-pixel, a third sub-pixel and a fourth sub-pixel, said display panel arranged to receive a plurality of input signals for displaying an image thereon, and wherein said plurality of input signals are represented by N binary bits, with a maximum of the input signals equal to $(2^N-1)$ with N being a positive integer greater than 1, and wherein said plurality of input signals comprises a first input signal, a second input signal, and a third input signal, said method comprising:

converting the input signals into a plurality of input data in luminance space;

determining an adjustment value from the plurality of input data in luminance space; and computing a plurality of adjusted data values from the plurality of input data in luminance space and the adjustment value, the plurality of adjusted data values comprising a first adjusted data value, a second adjusted data value, a third adjusted data value and a fourth adjusted data value in luminance space for use in the pixel, each of the first, second and third adjusted data values corresponding to the first input signal, the second input signal and the third input signal, wherein the display panel has a color temperature characteristic such that when the plurality of adjusted data values are color-temperature corrected according to the color temperature characteristic for providing a plurality of color-temperature corrected data in luminance space, the color-temperature corrected data comprising a first corrected data for use in the first sub-pixel, a second corrected data for use in the second sub-pixel, a third corrected data for use in the third sub-pixel and a fourth corrected data for use in the fourth sub-pixel, said determining and computing are carried out in a manner such that, at least when each of the first input signal, the second input signal and the third input signal has a value of $(2^N-1)$, each of the first corrected data, the second corrected data, the third corrected data and fourth corrected data is smaller than or equal to 0.5.

2. The method according to claim 1, wherein the fourth corrected data is smaller than or equal to any one of the first corrected data, the second corrected data and the third corrected data.

3. The method according to claim 1, wherein each of the first sub-pixel, the second sub-pixel, and the third sub-pixel has an pixel area equal to a first area, and the fourth sub-pixel has a pixel area equal to k times the first area, with k being a positive value greater than 0, and wherein k is selected such that each of the first corrected data, the second corrected data, the third corrected data and fourth corrected data is smaller than or equal to 0.5/k.

4. The method according to claim 3, wherein k is selected such that each of the first corrected data, the second corrected data, the third corrected data and fourth corrected data is also greater than or equal to 0.4/k.

5. The method according to claim 1, further comprising:

re-converting the first adjusted data value, the second adjusted data value, the third adjusted data value and the fourth adjusted data value in luminance space into a first output data signal, a second output data signal, a third output data signal and a fourth output data signal in signal space before the plurality of adjusted data values are color-temperature corrected.

6. The method according to claim 5, further comprising:

expanding the input data in luminance space by a multiplication factor before said determining; and re-adjusting the first adjusted data value, the second adjusted data value, the third adjusted data value and the fourth adjusted data value in luminance space by a reduction factor before said re-converting.

7. The method according to claim 6, wherein the reduction factor is a non-zero value equal to or smaller than the multiplication factor.

8. The method according to claim 6, wherein the plurality of input data in luminance space comprise a first input data, a second input data and a third input data, and wherein the multiplication factor is determined based on a maximum value and a minimum value among the first input data, the second input data and the third input data.

9. The method according to claim 6, wherein the plurality of input data in luminance space comprise a first input data, a second input data and a third input data, and wherein the multiplication factor is determined based on a maximum value and a minimum value among the first input data, the second input data and the third input data, such that the multiplication factor is equal to the ratio of V'max and Vmax, and if [Vmax−Vmin]/Vmax is smaller than 0.5, V'max is equal to 2, and if [Vmax−Vmin]/Vmax is equal to or greater than 0.5, V'max is equal to Vmax/[Vmax−Vmin], wherein Vmax is equal to the maximum value, and Vmin is equal to the minimum value.

10. The method according to claim 1, wherein the plurality of input data in luminance space comprise a first input data, a second input data and a third input data, and wherein the adjustment value is determined at least based on a minimum value among the first input data, the second input data and the third input data.

11. The method according to claim 1, wherein the plurality of input data in luminance space comprise a first input data, a second input data and a third input data, and wherein the adjustment value is determined at least based on a maximum value among the first input data, the second input data and the third input data.

12. A processor for use in a display panel comprising a plurality of pixels, each pixel comprising a first sub-pixel, a second sub-pixel, a third sub-pixel and a fourth sub-pixel, said display panel arranged to receive a plurality of input signals for displaying an image thereon, and wherein said plurality of input signals are represented by N binary bits, with a maximum of the input signals equal to $(2^N-1)$ with N being a positive integer greater than 1, and wherein said plurality of input signals comprises a first input signal, a second input signal, and a third input signal, said processor comprising:

a converting block configured for converting the input signals into a plurality of input data in luminance space;

a level adjusting block configured for determining an adjustment value from the plurality of input data in luminance space; and a data adjustment block configured for computing a plurality of adjusted data values from the plurality of input data in luminance space and the adjustment value, the plurality of adjusted data values comprising a first adjusted data value, a second adjusted data value, a third adjusted data value and a fourth adjusted data value in luminance space for use in the pixel, each of the first, second and third adjusted data values corresponding to the first input signal, the second input signal and the third input signal, wherein the display panel has a color temperature characteristic such that when the plurality of adjusted data values are color-temperature corrected according to the color temperature characteristic for providing a plurality of color-temperature corrected data in luminance space, the color-temperature corrected data comprising a first corrected data for use in the first sub-pixel, a second corrected data for use in the second sub-pixel, a third corrected data for use in the third sub-pixel and a fourth corrected data for use in the fourth sub-pixel, wherein the adjustment value is determined such that at least when each of the first input signal, the second input signal and the third input signal has a value of $(2^N-1)$, each of the first corrected data, the second corrected data, the third corrected data and fourth corrected data is smaller than or equal to 0.5.

13. The processor according to claim 12, wherein the adjustment value is determined such that the fourth corrected data is smaller than or equal to any one of the first corrected data, the second corrected data and the third corrected data.

14. The processor according to claim 12, wherein each of the first sub-pixel, the second sub-pixel, and the third sub-pixel has an pixel area equal to a first area, and the fourth sub-pixel has a pixel area equal to k times the first area, with k being a positive value greater than 0, wherein the adjustment value is determined such that each of the first corrected data, the second corrected data, the third corrected data and fourth corrected data is smaller than or equal to 0.5/k.

15. The method according to claim 14, wherein k is selected such that each of the first corrected data, the second corrected data, the third corrected data and fourth corrected data is also greater than or equal to 0.4/k.

16. The processor according to claim 12, further comprising:

a re-converting block configured for re-converting the first adjusted data value, the second adjusted data value, the third adjusted data value and the fourth adjusted data value in luminance space into a first output data signal, a second output data signal, a third output data signal and a fourth output data signal in signal space before the plurality of adjusted data values are color-temperature corrected.

17. The processor according to claim 16, further comprising:

a data expansion block configured for expanding the input data in luminance space by a multiplication factor before the level adjusting block determines the adjustment value; and a second data adjustment block configured for re-adjusting the first adjusted data value, the second adjusted data value, the third adjusted data value and the fourth adjusted data value in luminance space by a reduction factor before the re-converting block re-converts the first adjusted data value, the second adjusted data value, the third adjusted data value and the fourth adjusted data value in luminance space.

18. The processor according to claim 17, wherein the plurality of input data in luminance space comprise a first input data, a second input data and a third input data, and wherein the multiplication factor is determined based on a maximum value and a minimum value among the first input data, the second input data and the third input data.

19. The processor according to claim 17, wherein the plurality of input data in luminance space comprise a first input data, a second input data and a third input data, and wherein the multiplication factor is determined based on a maximum value and a minimum value among the first input data, the second input data and the third input data, such that the multiplication factor is equal to the ratio of V'max and Vmax, and if [Vmax−Vmin]/Vmax is smaller than 0.5, V'max is equal to 2, and if [Vmax−Vmin]/Vmax is equal to or greater than 0.5, V'max is equal to Vmax/[Vmax−Vmin], wherein Vmax is equal to the maximum value, and Vmin is equal to the minimum value.

20. The processor according to claim 12, wherein the plurality of input data in luminance space comprise a first input data, a second input data and a third input data, and wherein the adjustment value is determined at least based on a minimum value or the maximum value among the first input data, the second input data and the third input data.

* * * * *